United States Patent [19]

VonPhilp, Sr.

[11] Patent Number: 4,842,565

[45] Date of Patent: Jun. 27, 1989

[54] REVERSIBLE, STUFFED DOLL

[76] Inventor: Robert VonPhilp, Sr., 4247 Conway Blvd., Port Charlotte, Fla. 33952

[21] Appl. No.: 55,780

[22] Filed: May 28, 1988

[51] Int. Cl.[4] ..... A63H 3/12; A63H 3/02

[52] U.S. Cl. ..... 446/321; 446/369

[58] Field of Search ..... 446/369, 321, 327, 328, 446/329, 330, 337, 338, 370, 371, 372, 385, 387, 388

[56] References Cited

U.S. PATENT DOCUMENTS

| | | | |
|---|---|---|---|
| 1,396,766 | 11/1921 | McClelland | 446/321 |
| 1,966,986 | 7/1934 | Martin | 446/321 |
| 2,195,127 | 3/1940 | Brucker | 446/321 |
| 3,851,419 | 12/1974 | Kaelin | 446/321 |
| 4,107,873 | 8/1978 | Bauer | 446/321 |
| 4,413,442 | 11/1983 | McSweeney | 446/369 X |
| 4,563,159 | 1/1986 | Hills et al. | 446/369 X |
| 4,614,505 | 9/1986 | Schneider et al. | 446/321 X |
| 4,639,233 | 1/1987 | Brassfield | 446/321 |
| 4,695,264 | 9/1987 | McLeod, Jr. | 446/321 |

FOREIGN PATENT DOCUMENTS

| | | | |
|---|---|---|---|
| 609010 | 11/1960 | Canada | 446/321 |

*Primary Examiner*—Robert A. Hafer
*Assistant Examiner*—D. Neal Muir
*Attorney, Agent, or Firm*—Charles J. Prescott

[57] ABSTRACT

A stuffed doll is formed of two fabric sections with a cavity containing filling material between them. Each fabric section has on its outer facing surface accent devices giving it two different appearances of a toy animal or person. An additional fabric section is provided to conceal one of the two appearances. This additional fabric section can be moved when desired to cover the other appearance. A hat is secured to extend across the juncture of each fabric section and the additional fabric section so that a different hat is exposed for each appearance.

6 Claims, 1 Drawing Sheet

REVERSIBLE, STUFFED DOLL

BACKGROUND OF THE INVENTION

1. Field of the Invention

This invention relates generally to stuffed dolls, and more particularly to reversible, stuffed dolls which present a first appearance on one surface of the stuffed portion, and a second appearance on the other surface of the stuffed portion when the doll is reversed.

2. Description of Related Art

Stuffed dolls, particularly those having plush or simulated fur coverings, satisfy a desire in children and others for a soft and cuddly object to hold and caress. Often, such stuffed dolls are placed on the bed during the day, and join the owner in bed at night.

The present invention relates to a stuffed doll which is reversible so that it has a first appearance on one surface of the stuffed portion (which may, for example, represent a daytime appearance), and a second appearance on the opposite surface of the stuffed portion (which may represent a nighttime appearance). In either case, one appearance is concealed when the other is revealed. The change from one appearance to the other is performed much as a sock is turned inside out.

Reversible dolls have previously been disclosed, U.S. Pat. No. 4,336,665 discloses a toy having two head portions joined at the neck, and a shell fabric which can be moved to cover one head or the other.

U.S. Pat. No. 4,413,422 discloses a toy which can be converted from a pillow configuration to that of a simulated animal.

No previous stuffed toy is known which is turned inside out to change from one appearance to another.

It is therefore an object of this invention to provide a reversible, stuffed doll which can be changed from one appearance to another.

It is also an object of this invention to provide a reversible, stuffed doll which is changed in appearance by turning it inside out.

In accordance with these and other objects, which will become apparent hereafter, the instant invention will now be described with reference to the accompanying drawings.

DETAILED DESCRIPTION OF THE INVENTION

Referring to FIGS. 1–4, doll 10 has a first fabric section having an outer surface 12 and an inner surface

Figure 4:
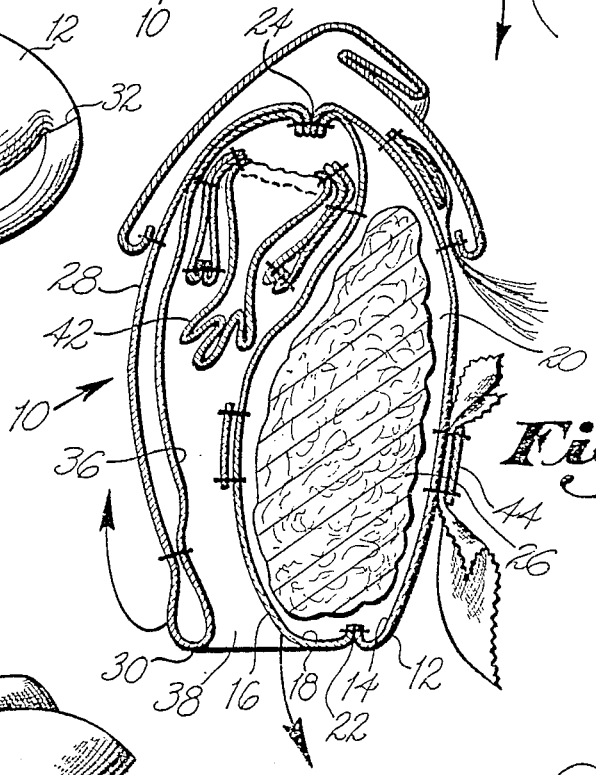
FIG. 4 is a cross-section taken on the line 4—4 of FIG. 1.

14 (FIG. 4). Doll 10 also has a second fabric section having an outer surface 16 and an inner surface 18. As shown in FIG. 4, the first and second fabric sections are joined along their edge portions to form an internal cavity 20. The edge portions may be joined by a seam such as bottom seam 22 and top seam 24; however, it is also contemplated that one or more of the joined edge portions may merely be folds of a continuous fabric section. Cavity 20 contains a sufficient quantity of filler material 26 to cause outer surfaces 12 and 16 of the first and second fabric sections to present a pronounced convex appearance. Filler material 26 may be any soft, somewhat resilient substance such as cotton batting.

Doll 10 also has a third fabric section 28 which is joined along its edge portions (except its bottom edge portion 30) to the first and second fabric sections. Seam 24 is one such joined edge portion. Seams 32 and 34 join the side edge portions of the first, second and third fabric sections. Since both surfaces of third fabric section 28 will be exposed, this fabric section should preferably be formed of a fabric having both surfaces of suitable appearance, such as terry cloth. Alternatively, as shown in FIG. 4, a fourth fabric section 36 may be used as the exposed surface. Fourth fabric section 36 may also merely be a continuation of third fabric section 28 having a fold at the bottom edge portion 30.

Figure 5:
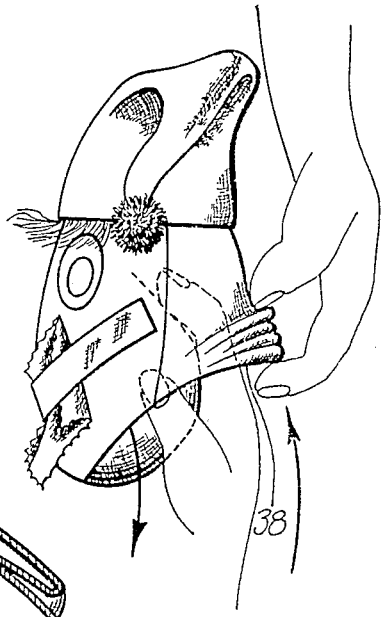
FIG. 5 represents the doll of FIG. 1 as it is being reversed.
Figure 3:
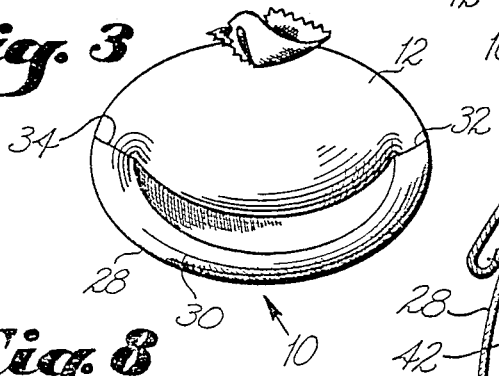
FIG. 3 is a bottom view of the doll of FIG. 1.

In accordance with the invention, stuffed doll 10 is reversible. As depicted in FIG. 5, doll 10 is reversed by placing one hand in the pocket 38 formed between second fabric section 16 and third fabric section 28 (or fourth fabric section 36 if one is used). The hand in pocket 38 grasps the second fabric section and the filling material 26 behind this fabric section, while the other hand moves third fabric section 28 to expose surface 16 of the second fabric section.

Figure 6:
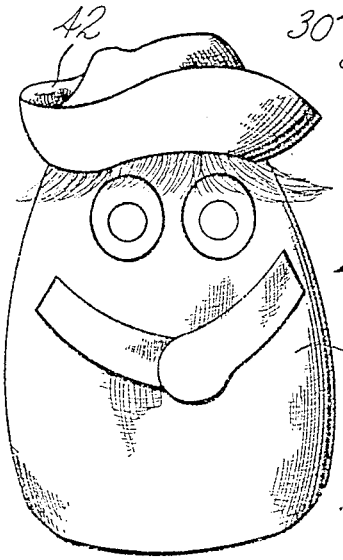
FIG. 6 is a front elevation of the doll of FIG. 1 in its reversed appearance.

FIG. 6 shows surface 16 as it is then revealed.

Figure 1:
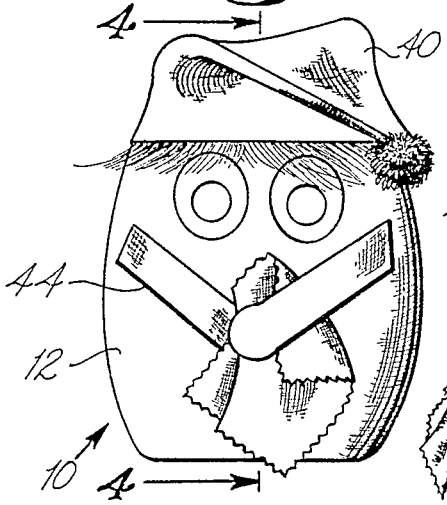
FIG. 1 is a front elevation of a reversible, stuffed doll in accordance with the invention showing a first appearance.
Figure 2:
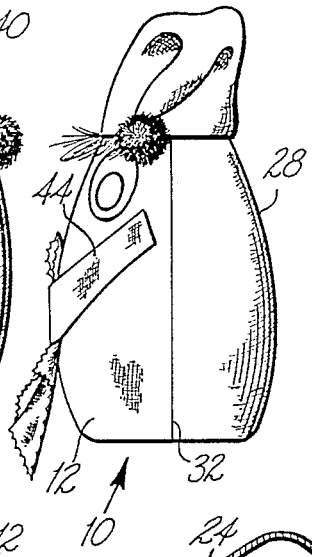
FIG. 2 is a side elevation of the doll of FIG. 1.

The basic structure of stuffed doll 10 is as described above; however, the doll derives its appeal (in addition to being stuffed) by the addition of accent devices. In FIG. 1, night cap 40 is positioned on the head of doll 10. As shown in FIG. 4, night cap 40 is sewn to the first fabric section and the third fabric section. Also shown in FIG. 4, is hat 42 which is folded in pocket 38 and secured to the second and third fabric sections. Hat 42 appears in FIG. 6 on the reversed doll. Other accent devices such as simulated arms 44 are secured to the doll by sewing or in other well known techniques.

Figure 7:
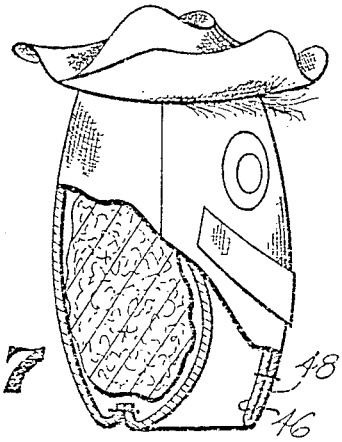
FIG. 7 is a side elevation, partially in cross-section, of an alternate embodiment of a reversible, stuffed doll.

FIG. 7 depicts an alternate embodiment of a stuffed doll wherein the accent devices are secured to third and fourth fabric sections 46 and 48, instead of the fabric sections forming the internal cavity containing the filling material.

Figure 8:
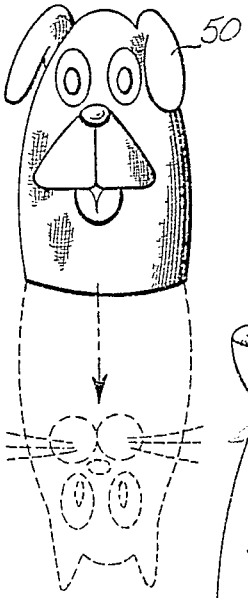
FIG. 8 is a front elevation of another version of a reversible, stuffed doll with its reversed appearance shown in phantom view.

FIG. 8 illustrates that the two appearances of the doll may represent different animals rather than different appearances of the same doll person. It should be noted that bulky accent devices such as the ear 50 or the hats in the other embodiment, are readily accommodated within the pocket.

It should be noted that the third fabric section which forms one side of the pocket of the doll will also appear convex, and allowance in fabrication must be made for the additional fabric for this reason. Also, fabric allowance for the third fabric section is needed to permit the reversing of the doll without causing the seams to break.

In general, the reversible, stuffed doll of this invention has a filler material container formed by fabric having opposed sides joined at a common margin. The doll also has a pocket formed by additional material which is secured along a portion of the common margin. This additional material may be moved from a position adjacent to, and concealing one of the opposed sides, to a position adjacent to, and concealing the other of the opposed sides. Accent devices such as eyes, ears, etc. are secured to each of the opposed sides to give a different appearance to the opposed sides—only one of which is exposed at a time. Other accent devices, such as hats, may be secured to extend across the common margin.

While the instant invention has been shown and described herein in what is conceived to be the most practical and preferred embodiment, it is recognized that departures may be made therefrom within the scope of the invention, which is therefore not to be limited to the details disclosed herein, but is to be afforded the full scope of the claims so as to embrace any and all equivalent apparatus and articles.

I claim:

1. A reversible stuffed doll head comprising:

a first fabric section and a second fabric section;

said first and second fabric sections each having an inner surface and an outer surface;

said fabric sections having edge portions including bottom edge portions;

said edge portions of said first and second fabric sections joined to form an internal cavity between said inner surfaces;

a filler material contained in said cavity separating said first and second fabric sections except at their joined edge portions forming said stuffed doll head;

each of said outer surfaces of said first and second fabric sections bearing accent devices representing first and second doll faces;

a third fabric section coextensive with said first and second fabric sections;

said third fabric section having edge portions including a bottom edge portion joined to said first and second fabric sections except at said bottom edge portion;

said bottom edge portion of said third fabric section and said bottom edge portions of said first and second fabric sections forming an opening through which said stuffed doll head may be deformably pushed to conceal one of said first and second faces and exhibit the other of said faces.

2. A reversible stuffed doll head in accordance with claim 1 further including:

a fourth fabric section having edge portions; and said fourth fabric section joined to said third fabric section along said edge portions of said fourth fabric section.

3. A reversible stuffed doll head in accordance with claim 1 further including:

at least one accent device secured to both said first and said third fabric sections.

4. A reversible stuffed doll head comprising:

cavity fabric for forming a cavity having opposed sides and a top and bottom with a common margin;

filler material contained in said cavity;

accent devices on each of said opposed sides opposed sides giving said opposed sides different facial appearances representing a daytime appearance and a nighttime appearance; and pocket fabric coextensive with and secured to said cavity fabric along said margin except at said bottom, whereby an opening is formed at said bottom for movement from a first position adjacent to and concealing one of said opposed sides to a second position adjacent and concealing the other of said opposed sides by deformably pushing said filled cavity through said opening.

5. A reversible stuffed doll head in accordance with claim 4 wherein:

said pocket fabric has a first section extending from said portion of said margin and a second section folded back to form a double thickness.

6. A reversible stuffed doll head comprising:

a first fabric section and a second fabric section each having a top and bottom and opposite side edges;

said first and second fabric sections having a common margin juncture;

said first and second fabric sections having a cavity therebetween;

filler material contained in said cavity separating said first and second fabric sections to form a stuffed head with spaced opposite sides;

a third fabric section and a fourth fabric section generally coextensive with said first and second fabric sections;

said third and fourth fabric sections joined to said first and second fabric sections along said common margin juncture except at said bottom forming an opening at said bottom;

said third and fourth fabric sections moveable from a position adjacent to one of said spaced opposite sides to a position adjacent to the other of said spaced opposite sides by deformably pushing said stuffed head through said opening;

a first set of accent devices secured to said one of said spaced opposite sides to provide a daytime appearance of said doll face;

a first hat secured partially to said one of said spaced opposite sides and partially to said third fabric section;

a second set of accent devices secured to said other of said spaced opposite sides to provide a nighttime appearance of said doll face; and a second hat secured partially to said other of said spaced opposite sides and partially to said fourth fabric section.

* * * * *

UNITED STATES PATENT AND TRADEMARK OFFICE

CERTIFICATE OF CORRECTION

PATENT NO. : 4,842,565

DATED : June 27, 1989

INVENTOR(S) : Robert VonPhilp, Sr.

It is certified that error appears in the above-identified patent and that said Letters Patent is hereby corrected as shown below:

In the claims:

Column 4, line 7, eliminate "opposed sides", second appearance.

Signed and Sealed this

Twentieth Day of March, 1990

*Attest:*

*Attesting Officer*

JEFFREY M. SAMUELS

*Acting Commissioner of Patents and Trademarks*